United States Patent [19]

Kowalski et al.

[11] 3,971,277

[45] July 27, 1976

[54] INTERMITTENTLY OPERABLE ROTARY CHOPPING APPARATUS FOR MATTED FIBROUS MATERIAL

[75] Inventors: Carl D. Kowalski; Lawrence R. Finn, both of Toledo; Richard C. Yawberg, Grand Rapids, all of Ohio

[73] Assignee: Owens-Corning Fiberglas Corporation, Toledo, Ohio

[22] Filed: June 19, 1975

[21] Appl. No.: 588,525

[52] U.S. Cl. ..... 83/176; 83/287; 83/335; 83/347

[51] Int. Cl.[2] ..... B26D 7/14; B26D 1/56

[58] Field of Search ..... 83/283, 335, 347, 345, 83/436, 491, 493, 593, 175, 287, 288, 176

[56] References Cited

UNITED STATES PATENTS 3,628,410 12/1971 Shields ..... 83/335 X

FOREIGN PATENTS OR APPLICATIONS 1,261,537 4/1961 France ..... 83/347

*Primary Examiner*—Willie G. Abercrombie

*Attorney, Agent, or Firm*—John W. Overman; Paul J. Rose

[57] ABSTRACT

Matted fibrous material is fed between a rotatable shaft having a chopping blade mounted thereon and a rubber-covered back-up roll cooperable with the blade. Clutch and brake means enable the blade shaft to be rotated intermittently through one turn to chop off a selected length of material. An upper portion of the back-up roll is above the plane of support of feed and discharge conveyors on opposite sides of the back-up roll, and a cam on the blade shaft compresses the material before it is chopped by the blade.

7 Claims, 8 Drawing Figures

INTERMITTENTLY OPERABLE ROTARY CHOPPING APPARATUS FOR MATTED FIBROUS MATERIAL

This invention relates generally to rotary choppers, and more particularly to a rotary chopper for relatively thick matted fibrous material.

An object of the invention is to provide a rotary chopper for matted fibrous material, the chopper being operable intermittently through one turn to chop off a selected length of the matted fibrous material.

Another object is to provide a rotary chopper for matted fibrous material including elevating and compressing means for the material adjacent a chopping blade, whereby mats with end surfaces substantially planar and perpendicular to top and bottom surfaces are produced.

Other objects and advantages will become apparent when the following specification is considered along with the accompanying drawings in which.

Figure 2:
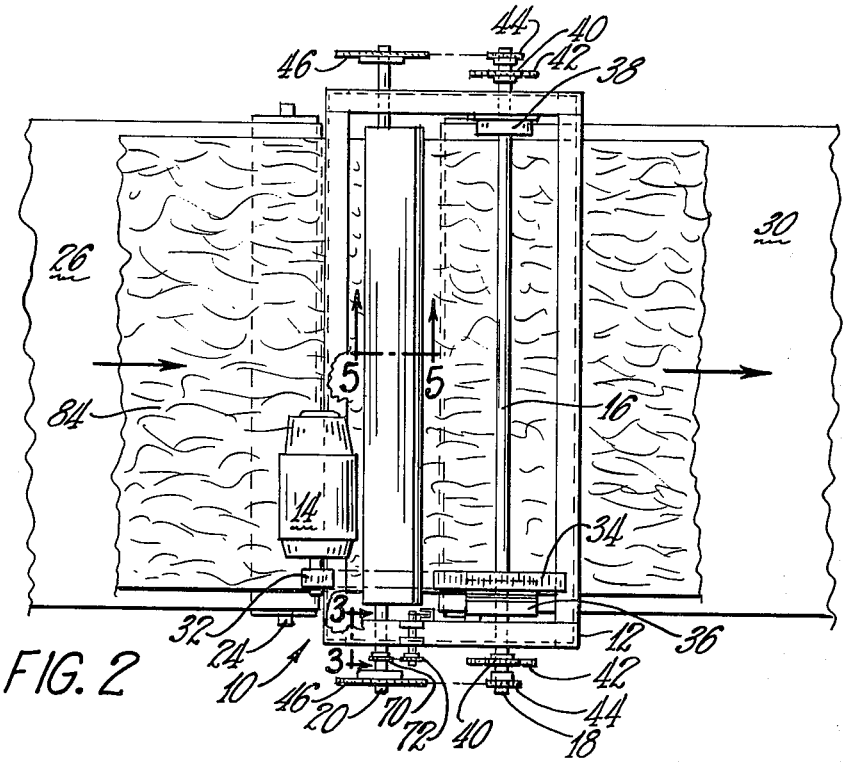
FIG. 2 is a top view of the rotary chopper of FIG. 1.
Figure 1:
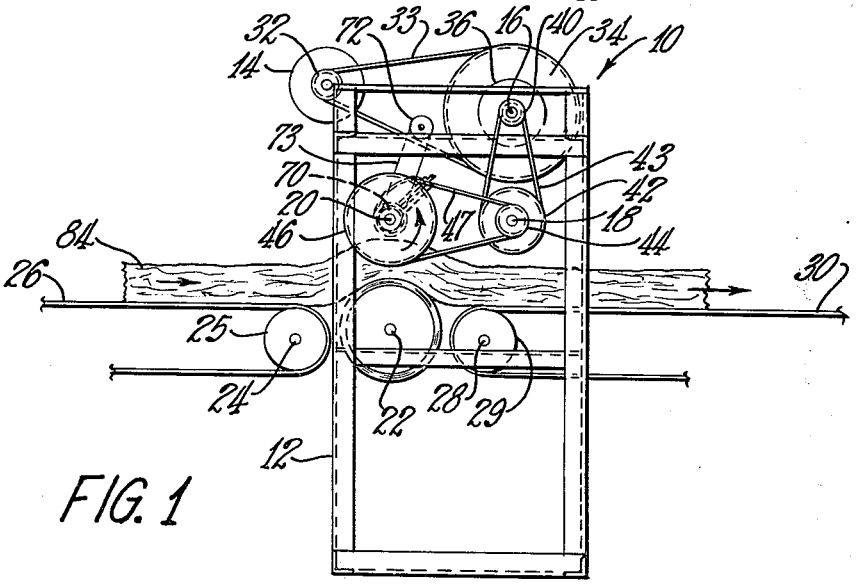
FIG. 1 is a side elevational view of a rotary chopper constructed in accordance with the invention, with portions omitted for clarity.
Figure 4:
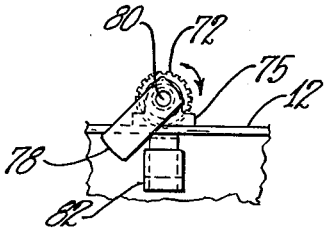
FIG. 4 is a fragmentary view taken from the lefthand side of FIG. 3.

With reference to the drawings, a rotary chopping apparatus 10 constructed in accordance with the invention is illustrated in FIGS. 1 and 2. The apparatus 10 includes a framework 12 to which a plurality of brackets (not shown) are secured for supporting a motor 14, a clutch and brake shaft 16, an intermediate drive shaft 18, a chopping blade shaft 20, and a back-up roll shaft 22. A shaft 24 is mounted in its own framework (not shown) and supports a front roller 25 of a feed conveyor having an endless belt 26. Similarly, a shaft 28 is mounted in a framework (not shown) receivable within the framework 12 and supports a rear roller 29 of a discharge conveyor having an endless belt 30.

The motor 14 continuously rotatably drives a gear 32 mounted on its output shaft. The gear 32 continuously drives a timing belt 33 and a flywheel gear 34 rotatably mounted on the shaft 16 adjacent one end thereof and operatively associated with a clutch mechanism 36. A brake mechanism 38 is operatively associated with the shaft 16 adjacent the other end thereof. Preferably the clutch mechanism 36 and the brake mechanism 38 are pneumatically operable under the control of solenoid operated valves (not shown). Two sprockets 40 are fixedly mounted respectively on extreme opposite end portions of the shaft 16 and are operatively connected respectively to two sprockets 42 fixedly mounted respectively adjacent opposite ends of the shaft 18 by a pair of roller chains 43. Two sprockets 44 are fixedly mounted respectively on extreme opposite end portions of the shaft 18 and are operatively connected respectively to two sprockets 46 fixedly mounted respectively on opposite end portions of the shaft 20 by a pair of roller chains 47.

As best shown in FIGS. 5–8, the portion of the shaft 20 within the framework 12 is reinforced by a concentric hollow shaft 50 secured at opposite ends to the shaft 20. A blade holding member 52 is welded to the outer surface of the hollow shaft 50. The member 52 is substantially collinear with the shaft 50 and extends radially therefrom. An outer end portion of the member 52 is recessed on one side and has a chopping blade 54 secured to that side by a clamping bar 56 held in position by a plurality of screws 57, only one of which is shown, threaded into a nut strip 58 on the opposite side. A plurality of braces 60, only one of which is shown, are welded to the shaft 50 in spaced relationship axially thereof and to the member 52 on the side thereof having the nut strip 58. A curved sheet metal cam 62 having a bent portion under the nut strip 58 has an opposite end portion secured to the shaft 50 by a plurality of screws 64, only one of which is shown. A hollow steel back-up roll 66 having a rubber sleeve 67 bonded thereto is secured at opposite end portions to the shaft 22. The shaft 22 is rotatably driven continuously by an appropriate motor, shafts, sprockets, and roller chains (not shown).

Figure 3:
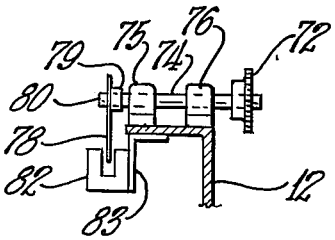
FIG. 3 is a sectional view taken generally along the line 3—3 of FIG. 2.
Figure 5:
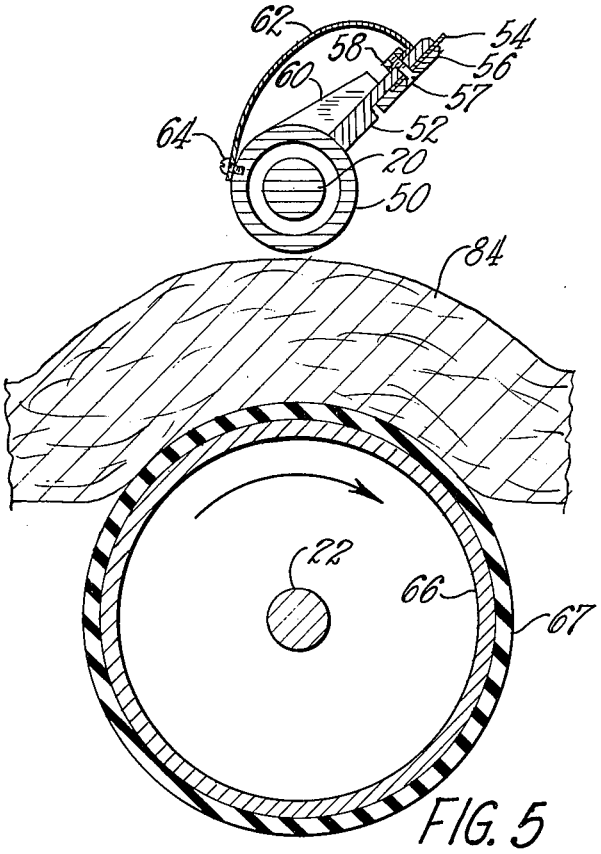
FIG. 5 is an enlarged fragmentary sectional view taken generally along the line 5—5 of FIG. 2 and showing a chopping blade of the rotary chopper in its normal, at-rest position.
Figure 6:
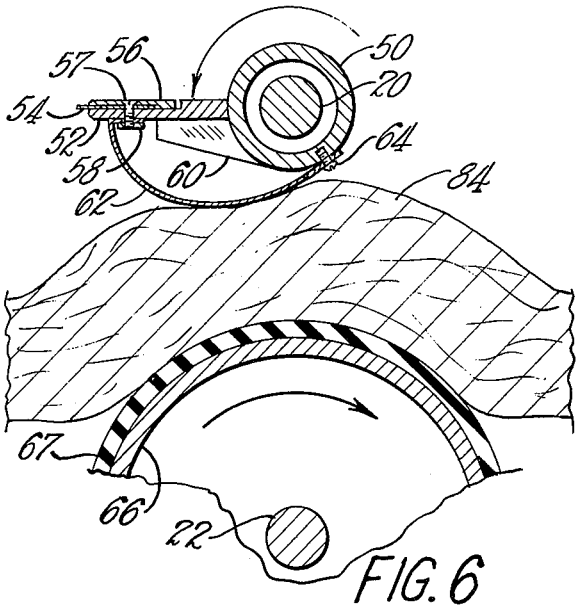
FIGS. 6–8 are views similar to FIG. 5 but showing progressive movement of the chopping blade to the chopping position of FIG. 8.
Figure 7:
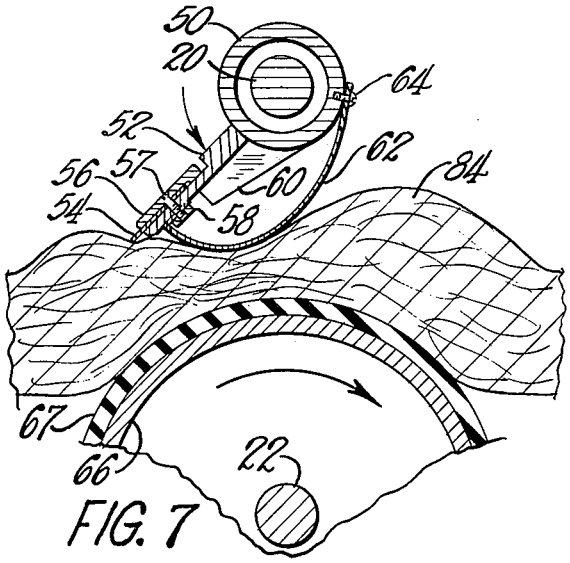
Figure 8:
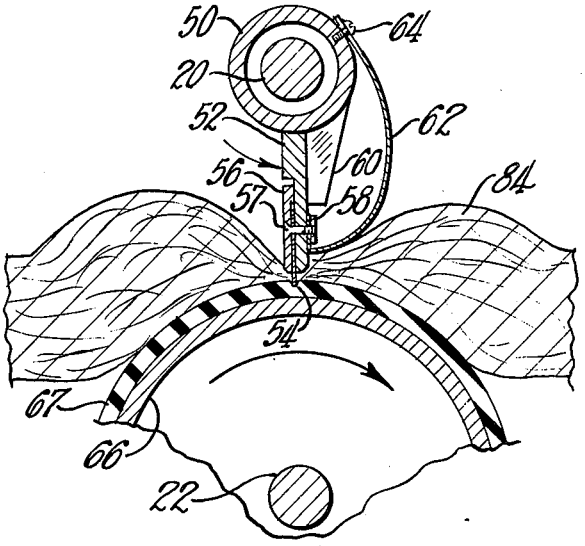

A sprocket 70 (FIGS. 1 and 2) on the shaft 20 is operatively connected to a sprocket 72 by a roller chain 73. The sprocket 72 is fixedly mounted on a shaft 74 (FIG. 3) rotatably mounted in a pair of bearing blocks 75 and 76 secured to the framework 12. A flat metallic flag 78 is secured to an end of the shaft 74 opposite the sprocket 72 and against a collar 79 on the shaft 74 by a screw 80. A proximity switch 82 is secured to a bracket 83 depending from the framework 12 and is operatively associated with the flag 78.

OPERATION

Matted fibrous material 84 is formed by a continuous process upstream of the rotary chopping apparatus 10 and fed thereto by the endless belt 26 of the feed conveyor. A pulse generator (not shown) may be operatively connected to a shaft of the feed conveyor system and to a counter (not shown) which effects the disengagement of the brake mechanism 38 and engagement of clutch mechanism 36 at a preselected pulse count determinative of the length of the chopped-off mats. The motor 14 continuously drives the flywheel gear 34, and when the brake mechanism 38 is disengaged and the clutch mechanism 36 is engaged, the shaft 16 is rotated. The sprockets 40 then drive the sprockets 42, shaft 18, sprockets 44, sprockets 46, and shaft 20 to chop off a mat of the selected length from the matted fibrous material 84, the mat being carried away by the endless belt 30 of the discharge conveyor. The shaft 20 also drives the sprocket 70, sprocket 72, shaft 74, and flag 78. As the flag 78 passes by the proximity switch 82, the activation of the switch 82 effects the disengagement of the clutch mechanism 36 and the engagement of the brake mechanism 38, a time delay being provided to enable the flag 78 to clear the switch 82 so as not to prevent subsequent engagement of the clutch mechanism 36 and disengagement of the brake mechanism 38 under the control of the counter (not shown). The disengagement of the clutch mechanism 36 and engagement of the brake mechanism 38 stops the rotation of the shaft 16, the shaft 20 being stopped with the chopping blade 54 in the position shown in FIG. 5.

As shown in FIG. 1, the upper portion of the back-up roll 66 with the rubber sleeve 67 is above plane of support afforded by the upper portions of the endless belts 26 and 30, and the matted fibrous material 84 is thus raised up as it passes over the back-up roll 66. As the chopping blade 54 moves from its rest position of FIG. 5 to its chopping position of FIG. 8, the cam 62 compresses the material 84 a considerable amount before the chopping blade is operatively engaged with the rubber sleeve 67 on the back-up roll 66. After the chopping operation, the end portions of the chopped-off mats substantially resume their original thickness. Both the elevating of the material 84 by the back-up roll 66 and the compressing thereof by the cam 62 ahead of the chopping blade 54 result in substantially square ends on the chopped-off mats after the end portions resume their original thickness. The end surfaces on the chopped-off mats are thus substantially planar and substantially perpendicular to the top and bottom surfaces of the mats after the end portions resume their original thickness.

Various modifications may be made in the structure shown and described without departing from the spirit and scope of the invention as set forth in the following claims.

We claim:

1. Rotary chopping apparatus for chopping resiliently compressible matted fibrous material fed continuously thereto into mats of a pre-selected length discharged therefrom, the apparatus comprising a back-up roll, a rotatably mounted chopping blade intermittently driven while the apparatus is in operation and cooperatively associated with the back-up roll, means for rotatably driving the chopping blade from a rest position through one revolution upon the passing of substantially a pre-selected length of the matted fibrous material across the back-up roll, means for stopping the chopping blade in its rest position after the one revolution until additional matted fibrous material of a length substantially equal to the pre-selected length has passed the back-up roll, and a cam associated with the chopping blade and mounted rotationally ahead thereof for progressively compressing the matted fibrous material against the back-up roll, by moving a top surface of the material progressively closer to the back-up roll before the chopping thereof by the cooperative action of the chopping blade and the back-up roll, to aid in effecting end surfaces on the chopped-off mats substantially planar and substantially perpendicular to top and bottom surfaces of the mats after end portions thereof resume their original thickness from a compressed state occurring during the chopping.

2. Rotary chopping apparatus as claimed in claim 1 and feed and discharge conveyors associated therewith respectively on opposite sides thereof, the feed conveyor providing a plane of support for the matted fibrous material fed thereby to the rotary chopping apparatus and the discharge conveyor providing a plane of support for the chopped-off mats carried thereby from the rotary chopping apparatus, an upper portion of the back-up roll being above the planes of support of the feed and discharge conveyors whereby the matted fibrous material is raised as it passes over the back-up roll and curved partially therearound to aid along with the cam in effecting the substantially planar and perpendicular end surfaces on the chopped-off mats.

3. The combination as claimed in claim 2 wherein the back-up roll is rotatably mounted and is continuously driven while the rotary chopping apparatus is in operation and the chopping blade is intermittently driven.

4. Rotary chopping apparatus as claimed in claim 1 wherein the back-up roll is rotatably mounted and is continuously driven while the apparatus is in operation and the chopping blade is intermittently driven.

5. Rotary chopping apparatus for chopping resiliently compressible matted fibrous material into mats of a pre-selected length, a feed conveyor associated with the chopping apparatus on one side thereof for feeding the matted fibrous material to the chopping apparatus and providing a plane of support for the material, and a discharge conveyor associated with the chopping apparatus on the opposite side thereof from the feed conveyor for carrying chopped-off mats from the chopping apparatus and providing a plane of support for the mats, the rotary chopping apparatus comprising a back-up roll, a rotatably mounted chopping blade intermittently driven while the apparatus is in operation and cooperatively associated with the back-up roll, means for rotatably driving the chopping blade from a rest position through one revolution upon the passing of substantially a pre-selected length of the matted fibrous material across the back-up roll, and means for stopping the chopping blade in its rest position after the one revolution until additional matted fibrous material of a length substantially equal to the pre-selected length has passed across the back-up roll, an upper portion of the back-up roll being above the planes of support of the feed and discharge conveyors whereby the matted fibrous material is raised as it passes over the back-up roll and curved partially therearound to aid in effecting end surfaces on the chopped-off mats substantially planar and substantially perpendicular to top and bottom surfaces of the mats after end portions thereof resume their original thickness from a compressed state occurring during the chopping.

6. The combination as claimed in claim 5 wherein the back-up roll is rotatably mounted and is continuously driven while the apparatus is in operation and the chopping blade is intermittently driven.

7. Rotary chopping apparatus for chopping resiliently compressible matted fibrous material continuously fed thereto into mats of a pre-selected length discharged therefrom, the apparatus comprising a rotatably mounted back-up roll and a rotatably mounted chopping blade cooperatively associated with the back-up roll, the back-up roll being continuously driven and the chopping blade being intermittently driven while the apparatus is in operation, means for rotatably driving the chopping blade from a rest position through one revolution upon the passing of substantially a pre-selected length of the matted fibrous material across the continuously driven back-up roll, and means for stopping the chopping blade in its rest position after the one revolution until additional matted fibrous material of a length substantially equal to the pre-selected length has passed across the back-up roll.

* * * * *